US006006371A

United States Patent [19]

Korte

[11] Patent Number: 6,006,371

[45] Date of Patent: Dec. 28, 1999

[54] FLUSH VALVE

[75] Inventor: Hermann Korte, Bad Oeynhausen, Germany

[73] Assignee: DAL-Georg Rost & Sohne Sanitaramaturen GmbH, Porta Westfalica, Germany

[21] Appl. No.: 09/176,163

[22] Filed: Oct. 21, 1998

[30] Foreign Application Priority Data

Nov. 4, 1997 [DE] Germany ..... 197 48 622

[51] Int. Cl.[6] ..... E03D 1/34

[52] U.S. Cl. ..... 4/391

[58] Field of Search ..... 4/389, 390, 391

[56] References Cited

U.S. PATENT DOCUMENTS 547,505 10/1895 Scott ..... 4/389

2,131,765 10/1938 Teahen ..... 4/391 X

*Primary Examiner*—Robert M. Fetsuga

*Attorney, Agent, or Firm*—Herbert Dubno; Andrew Wilford

[57] ABSTRACT

A flush valve has a valve ring defining a downwardly open valve port, an overflow tube centered on an upright axis and having a lower end opening into the valve port, and a valve body at the tube lower end displaceable relative to the port between a closed blocking position and an open position. Mechanism inside the tube lifts the valve body into the open position. A float in the tank adjacent the port cooperates with a latch system connected to the valve body for holding the body in the open position while the float is generally submerged. The tube is internally formed with an inwardly projecting ridge. The mechanism includes a frame inside the tube and fixed axially in the tank, at least one claw axially displaceable in the tube relative to the frame and engageable with the ridge, an actuating element accessible from outside the tank above the tube and axially aligned with the tube, and a direction-reversing linkage mounted on the frame and connected between the actuating element and the claw for raising the claw when the element is depressed.

20 Claims, 11 Drawing Sheets

Fig. 12
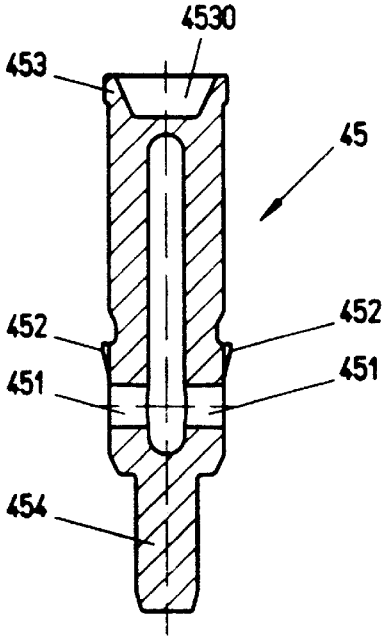
Fig. 13
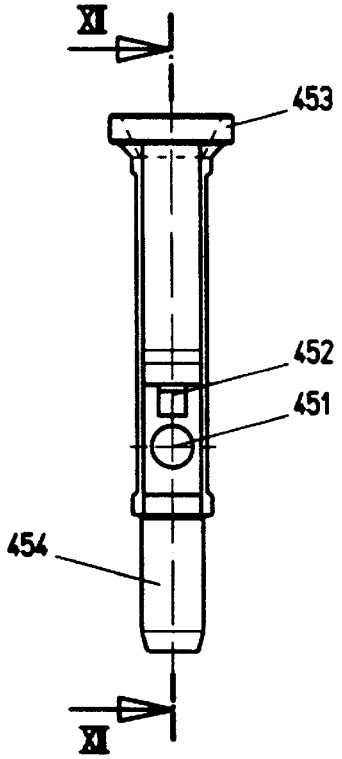
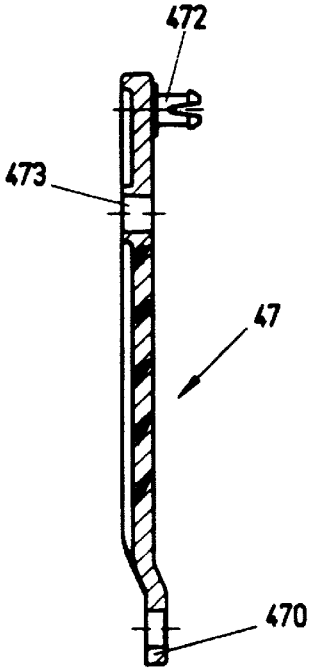
Fig. 14
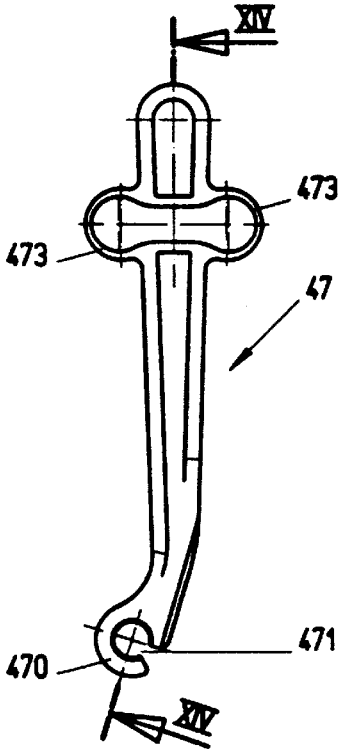
Fig. 15

Fig. 16
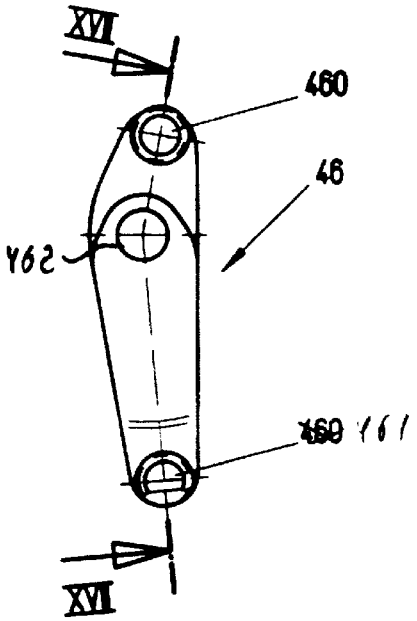
Fig. 17
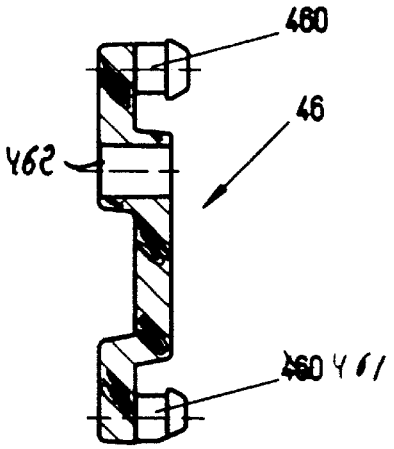
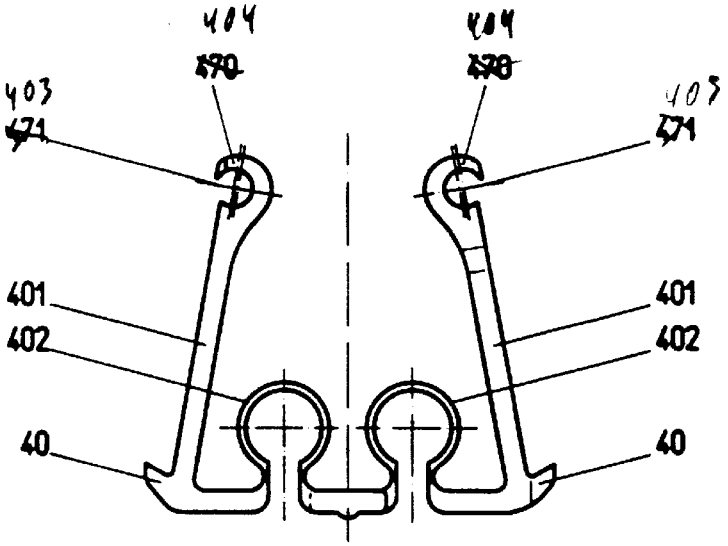
Fig. 18
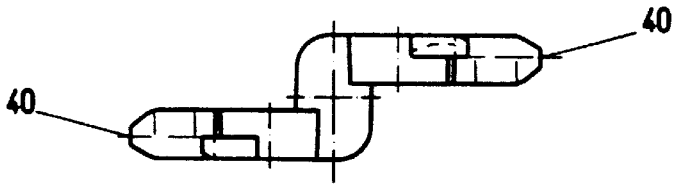
Fig. 19

Fig. 20
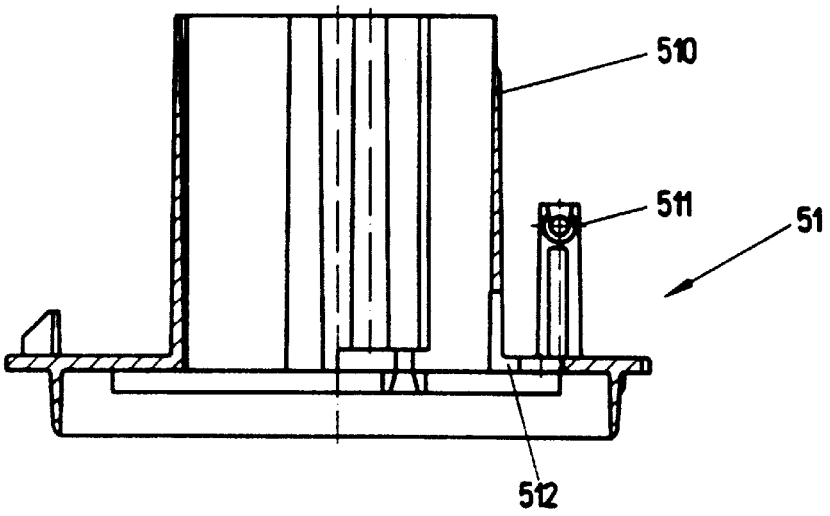
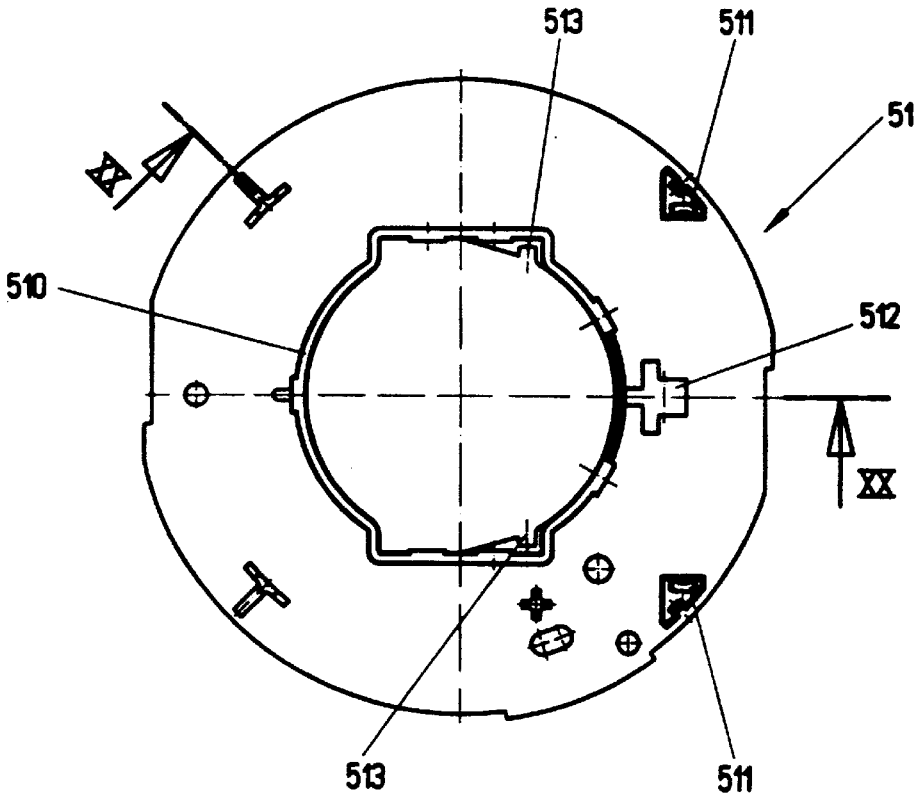
Fig. 21

Fig. 22
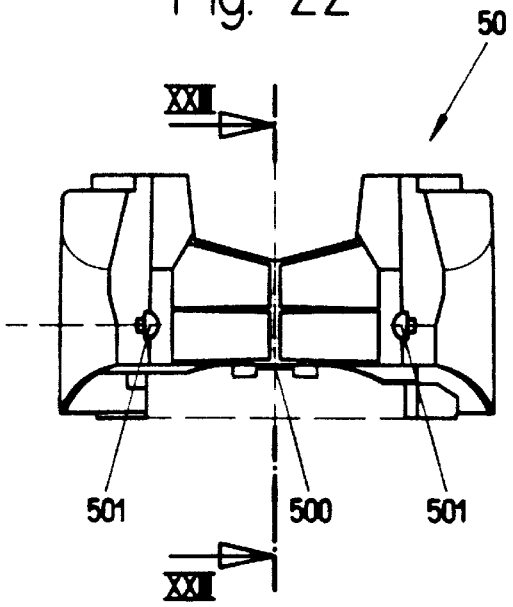
Fig. 23
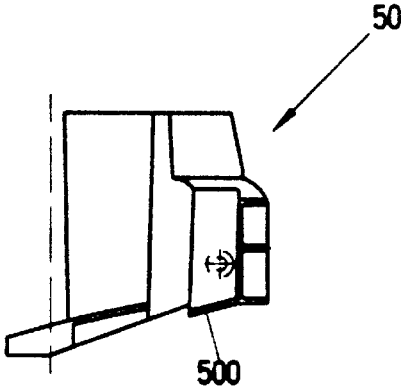
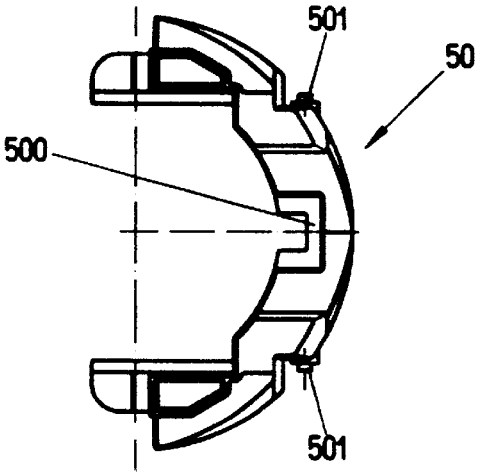
Fig. 24

FLUSH VALVE

FIELD OF THE INVENTION

The present invention relates to a flush valve. More particularly this invention concerns such a valve used in a toilet tank.

BACKGROUND OF THE INVENTION

A standard flush valve is provided at an outlet port formed in a bottom wall of a toilet tank. When actuated it allows the water in the tank to rush out through the port and flush the toilet. Such a valve must remain open long enough for all the water to run out.

In order to prevent the tank from overfilling, there is invariably an upright overflow tube whose open upper end is at a level above which the water should not go, and whose lower end opens into the outlet port. Thus if for some reason the float-controlled fill valve fails, the tank will not overflow.

The flush valve itself normally is a mechanism provided adjacent the overflow tube so that the tank must be dimensioned to provide space for it. Furthermore this flush valve is exposed in the tank and can easily get damaged during installation or if something falls into the tank.

OBJECTS OF THE INVENTION

It is therefore an object of the present invention to provide an improved flush valve.

Another object is the provision of such an improved flush valve which overcomes the above-given disadvantages, that is which is very compact and that is protected from damage before and after installation.

SUMMARY OF THE INVENTION

A flush valve has according to the invention a valve ring defining a downwardly open valve port, an overflow tube centered on an upright axis and having a lower end opening into the valve port, and a valve body at the tube lower end displaceable relative to the port between a closed blocking position and an open position. Mechanism inside the tube lifts the valve body into the open position. A float in the tank adjacent the port cooperates with a latch system connected to the valve body for holding the body in the open position while the float is generally submerged.

Thus this arrangement is extremely compact. All the operating mechanism is safely housed inside the overflow tube so that it takes up no extra space in the tank and is well protected before and after installation.

The overflow tube according to the invention is internally formed with an inwardly projecting ridge. The mechanism includes a frame inside the tube and fixed axially in the tank, at least one claw axially displaceable in the tube relative to the frame and engageable with the ridge, an actuating element accessible from outside the tank above the tube and axially aligned with the tube, and a direction-reversing linkage mounted on the frame and connected between the actuating element and the claw for raising the claw when the element is depressed. Furthermore a tubular guide has a lower end fixed to the frame and an upper end provided with a guide for the actuating element, and a rod extends downward from the actuating element. A plunger axially displaceable in the frame engages a lower end of the rod, and a spring is braced between the plunger and the frame and urges the rod and element upward. At least one lever centrally pivoted on the frame has one end connected to the plunger and an opposite end connected to the claw so that when the element is moved axially downward the one end moves axially downward and the other end moves axially upward. An axially elastically limitedly compressible link is connected between the plunger and the one end of the lever. This link has a pivot pin and the plunger is formed with seat a radially open seat receiving the pin. The frame is formed with a slot along which the pin is axially displaceable. The lever has a lower end formed with a pivot pin and the claw is formed with slotted elastically deformable eye engaged over the pivot pin. Furthermore the plunger is formed with at least one radially outwardly projecting tab and the frame is formed with an axially extending slot receiving the tab and limiting axial displacement of the plunger in the frame. In addition this the plunger has an enlarged head guided and axially displaceable in the tubular guide.

The claw according to the invention comprises a pair of diametrally opposite outwardly projecting claws and a spring formation between them and urging them diametrally apart. In addition the valve body is formed at the axis with a diametral axially through going slot and, angularly offset therefrom with at least one seat. The frame has a lower end formed as a hook engageable through the slot and, on rotation through an angle, in the seat.

The frame in accordance with the invention is formed below the mechanism with a crosswise partition disk and the overflow tube has a lower end of reduced diameter generally complementary to that of the disk. The disk generally blocks flow through the overflow tube in the open position of the valve body. Thus the mechanism is not subjected to a violent flow of water each time the valve is actuated.

The valve body according to the invention is formed with an upwardly extending large-diameter sleeve spacedly surrounding the tube and formed with radially through going flow apertures, a transverse wall extending inward from an upper end of the sleeve, and an upwardly extending smaller-diameter sleeve closely surrounding and guiding the tube and extending up from the wall. The float is U-shaped, partially surrounds the smaller-diameter sleeve, and is pivotal above the wall on the valve body between a tipped position when submerged and an untipped position when not submerged. The valve body has an upwardly directed hook engageable through the wall with the float only in the tipped position thereof.

The valve body can also be formed with an annular outer wall projecting upward from the wall radially outward of the smaller-diameter sleeve and forming with the wall and smaller-diameter inner sleeve an upwardly open annular compartment holding the float. The valve body is also formed with an aperture into the compartment and is provided with means for limiting flow through the aperture so that the flow-limiter can control the rate at which the compartment drains and thereby the amount of time the flush valve will hold open.

BRIEF DESCRIPTION OF THE DRAWING

The above and other objects, features, and advantages will become more readily apparent from the following description, reference being made to the accompanying drawing in which:

FIG. 12 is an axial section through the plunger of the valve mechanism;

FIG. 13 is a side view of the plunger, line XII—XII showing the section plane of FIG. 12;

FIG. 14 is an axial section through one of the operating links of the mechanism;

FIG. 15 is a side view of the operating link of FIG. 14, line XIV—XIV showing the section plane of FIG. 14;

FIG. 16 is a side view of an operating lever of the mechanism;

FIG. 17 is a section taken along line XVII—XVII of FIG. 16;

FIGS. 18 and 19 are side and bottom views of the entrainment claw of the mechanism;

FIG. 20 is an axial section through the float-support element of the valve;

FIG. 21 is a top view of the element of FIG. 20, line XX—XX showing the section plane of FIG. 20;

FIG. 22 is a side view of the float;

FIG. 23 is a section taken along line XXIII—XXIII of FIG. 22; and

FIG. 24 is a top view of the float.

SPECIFIC DESCRIPTION

Figure 1:
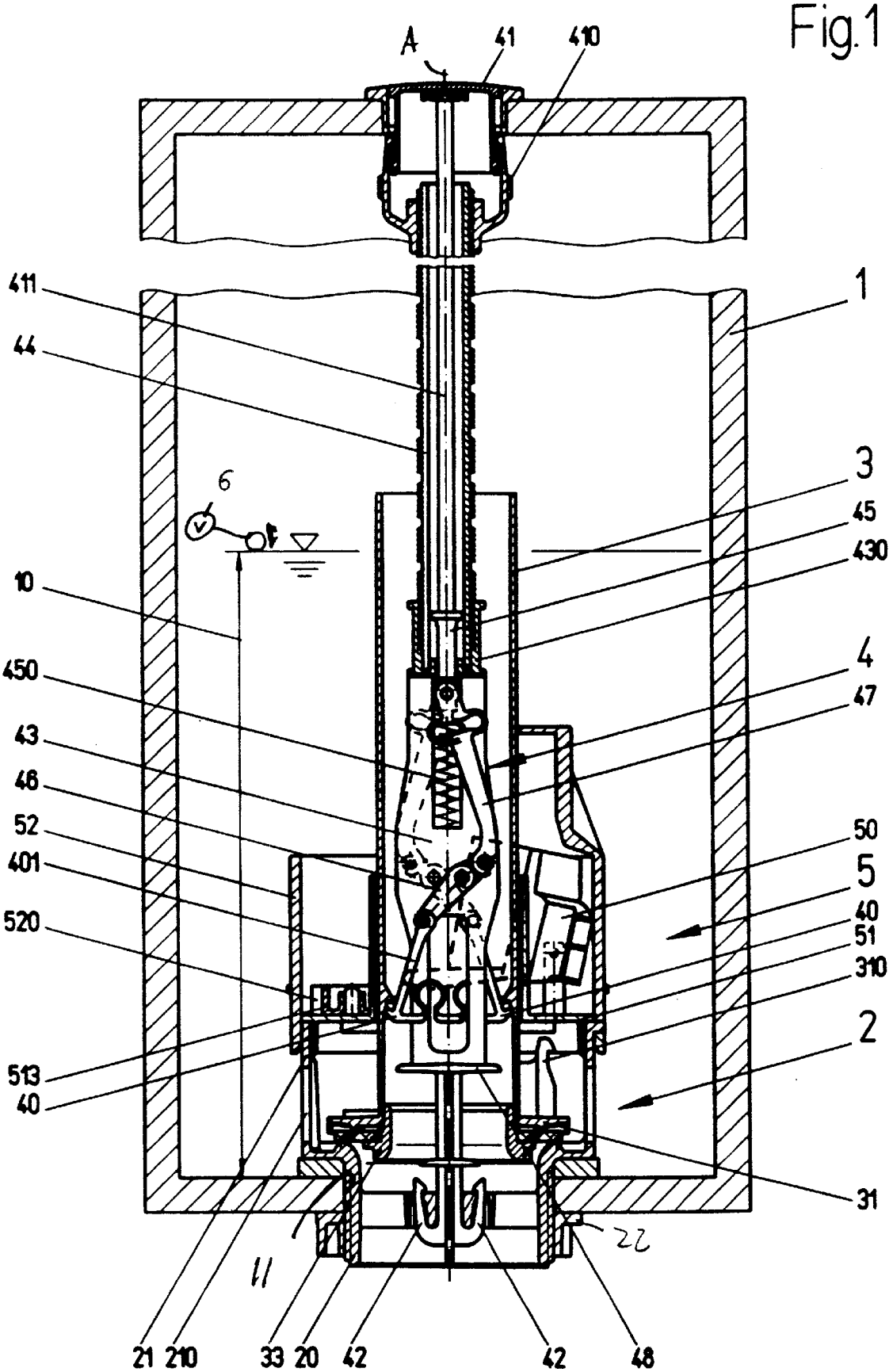
FIG. 1 is a vertical section through the valve according to the invention in the closed and unactuated position.

As seen in FIG. 1 a toilet tank 1 normally filled to a level 10 with water is fitted in a port 11 in its bottom wall with a valve 2 normally holding the water in the tank 1, but openable to let it flow out through the port 11. An overflow tube 3 centered on an axis A has an upper end above the level 10 and a lower end coaxial with and opening into the port 11. A mechanism 4 inside the tube 3 can be operated to open the valve 2. A float and latch system 5 serves to hold the valve 2 open until substantially all the water has flowed out of the tank 1. A float-controlled fill valve indicated schematically at 6 serves to fill the tank 1.

Figure 6:
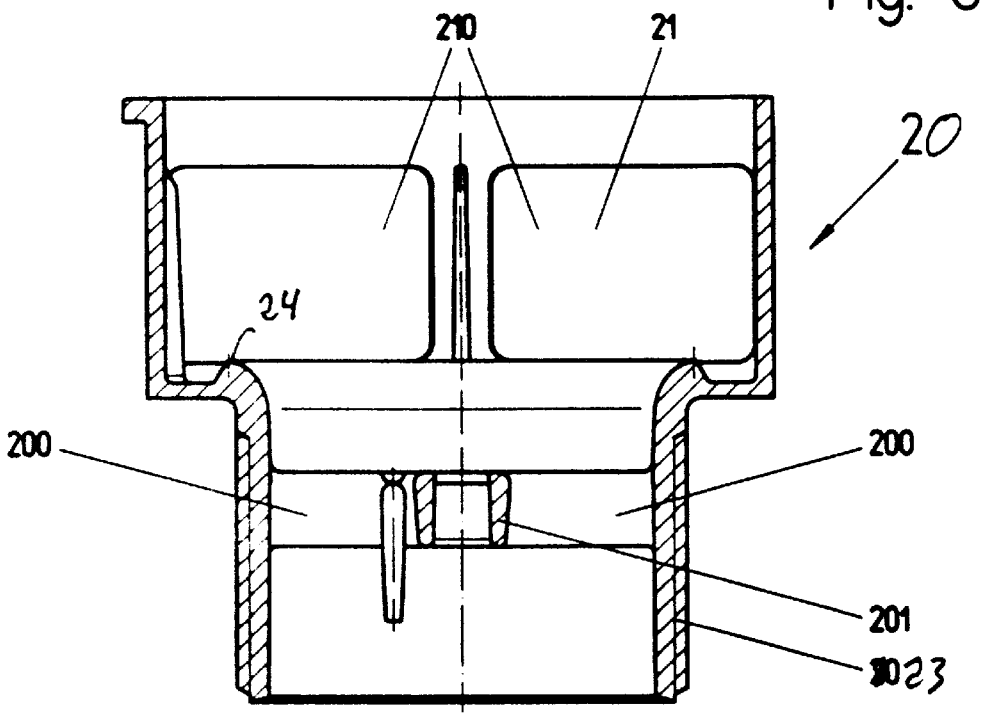
FIG. 6 is a large-scale axial section through the valve sleeve.
Figure 7:
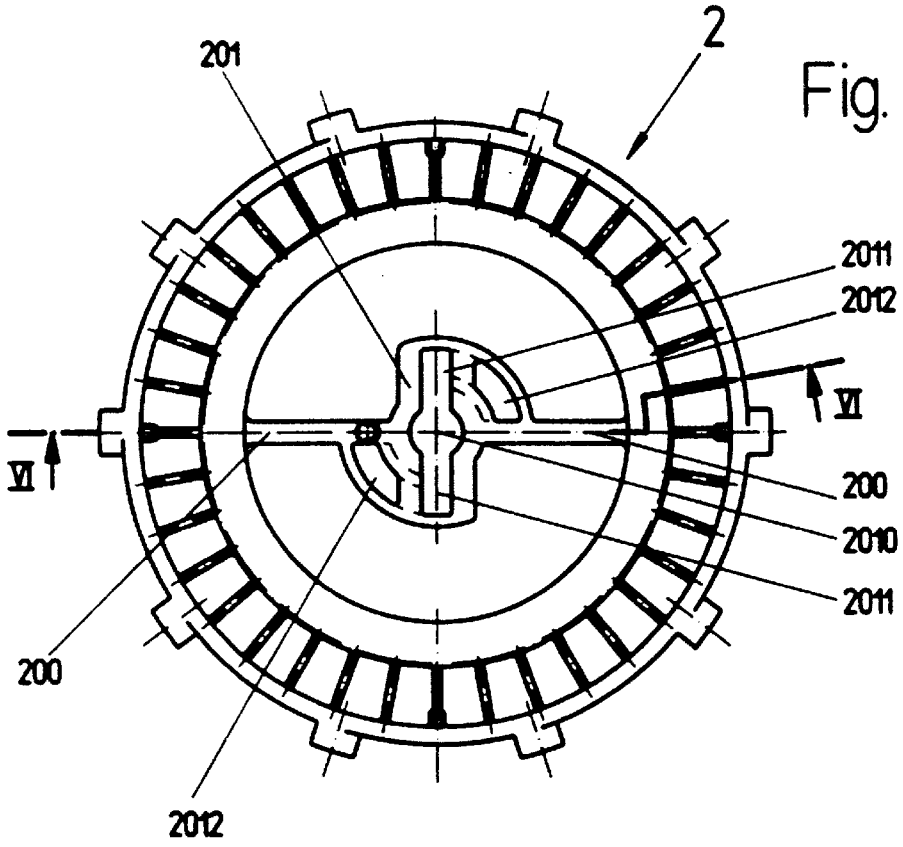
FIG. 7 is a top view of the valve sleeve.

The valve 2 basically comprises as shown in FIGS. 6 and 7 a stepped sleeve 20 having an externally threaded small-diameter collar 23 that passes through the port 11 where it is secured by a nut 22 and a wider upper wall or collar 21 formed with an array of apertures or holes 210 permitting free flow radially through the wall 21. In addition the sleeve 20 forms an upwardly directed annular seat 24 centered on the axis A. Internally the valve sleeve 20 has a pair of diametral ribs 200 supporting a center hub 201 formed with a crosswise slot 2011 and, 45° offset from this slot 2011, with a pair of throughgoing seat holes 2012 whose functions are described below.

Figure 3:
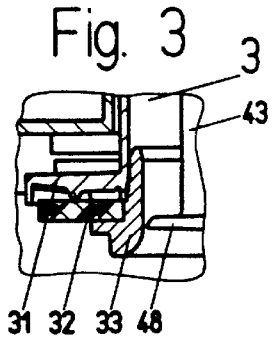
FIG. 3 is a large-scale view of a detail of FIG. 2.
Figure 5:
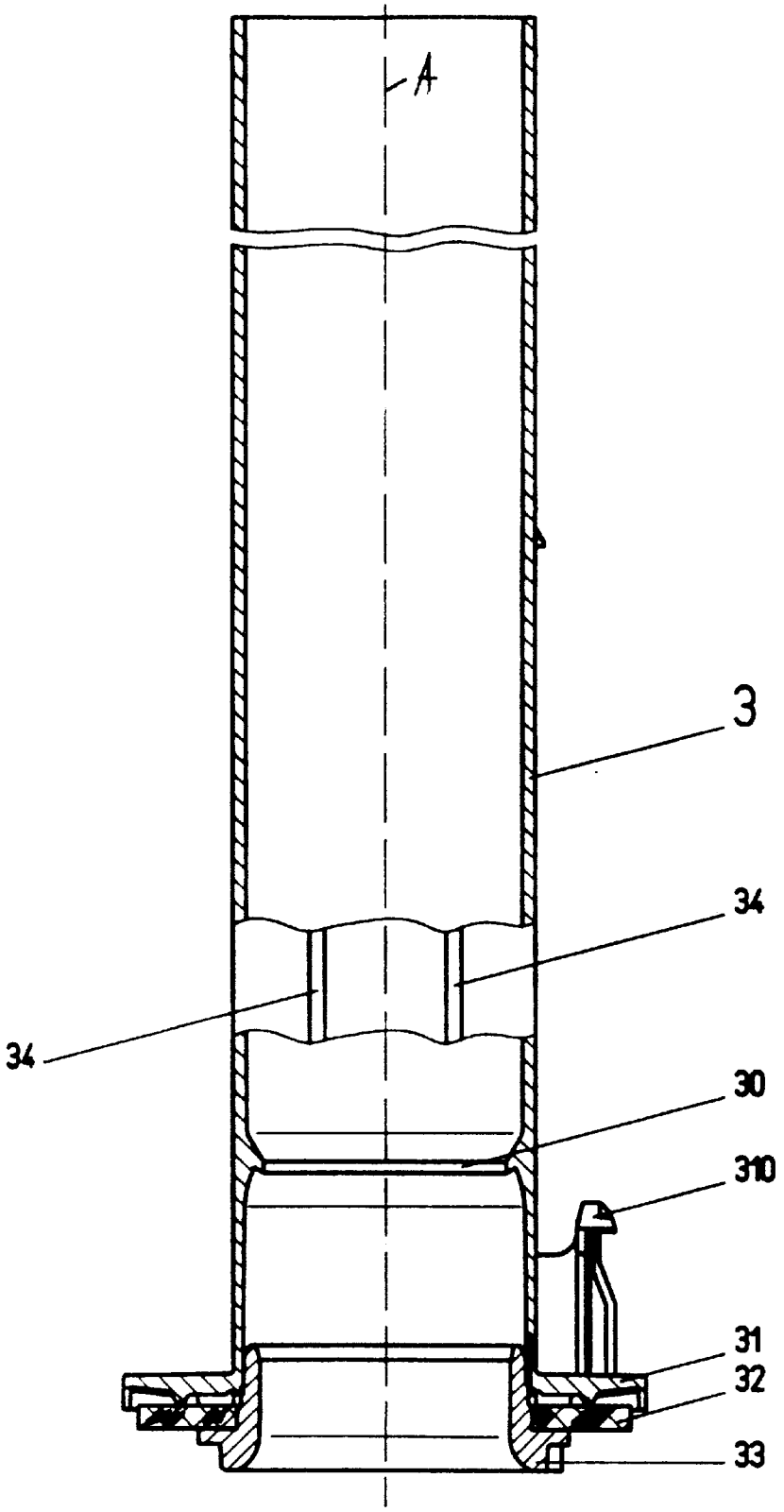
FIG. 5 is a large-scale axial section through the overflow tube.

As seen in FIGS. 3 and 5 the overflow tube 3 has a lower end formed with a radially outwardly directed flange 31 on the bottom of which is an elastomeric washer 32 engageable with the annular valve seat 24 and held in place by a ring 33. Thus when this tube 3 is sitting on the seat 24, the only flow down through the port 11 is through the tube 3 itself, when the water level 10 is over the top of this tube 3. In addition this tube 3 is formed internally with a downwardly hooked ridge 30 and with external axially extending ridges 34. A hook 310 extends axially upward from the flange 31.

Figure 2:
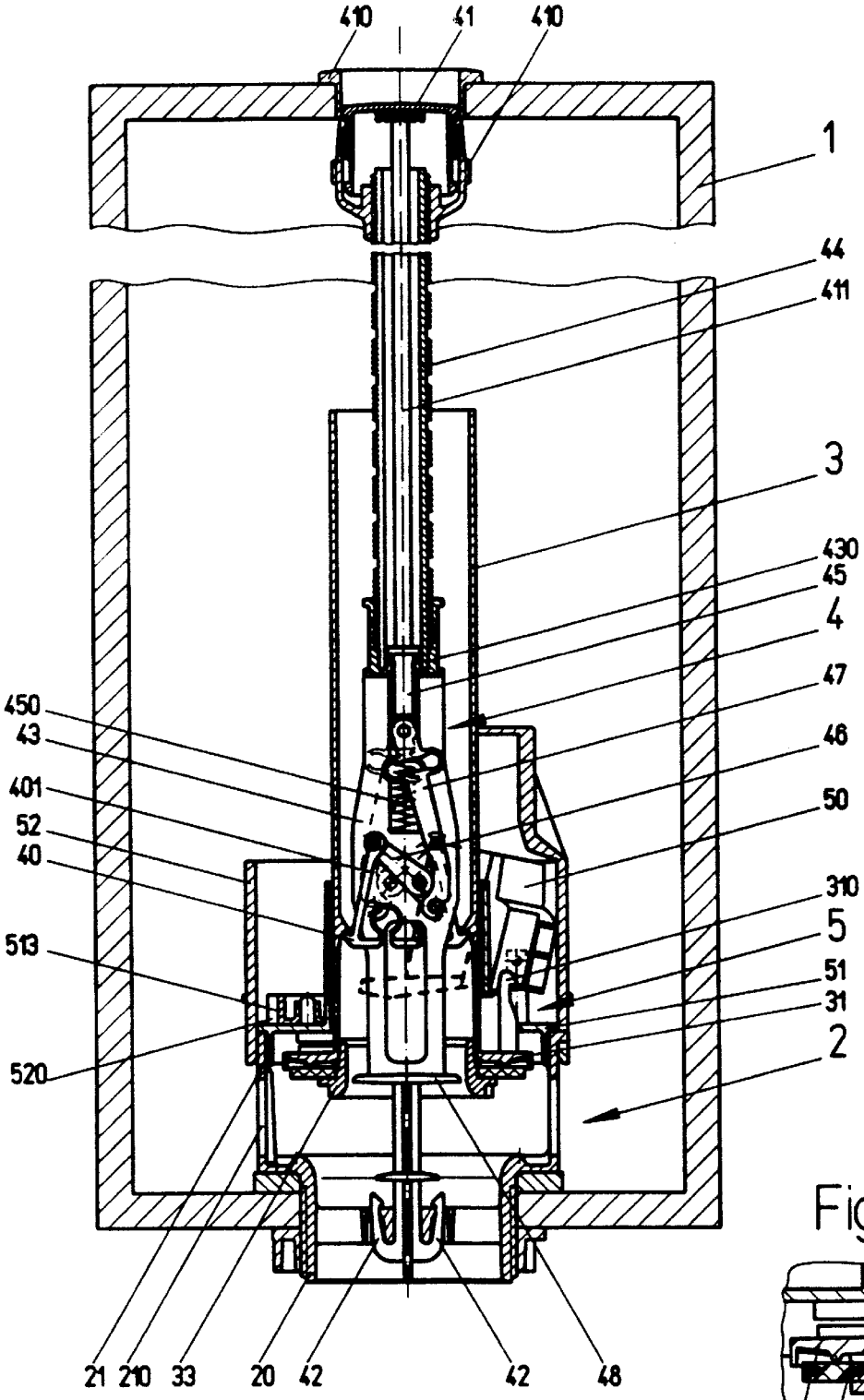
FIG. 2 is a section like FIG. 1 but with the valve in the open and actuated position.
Figure 4:
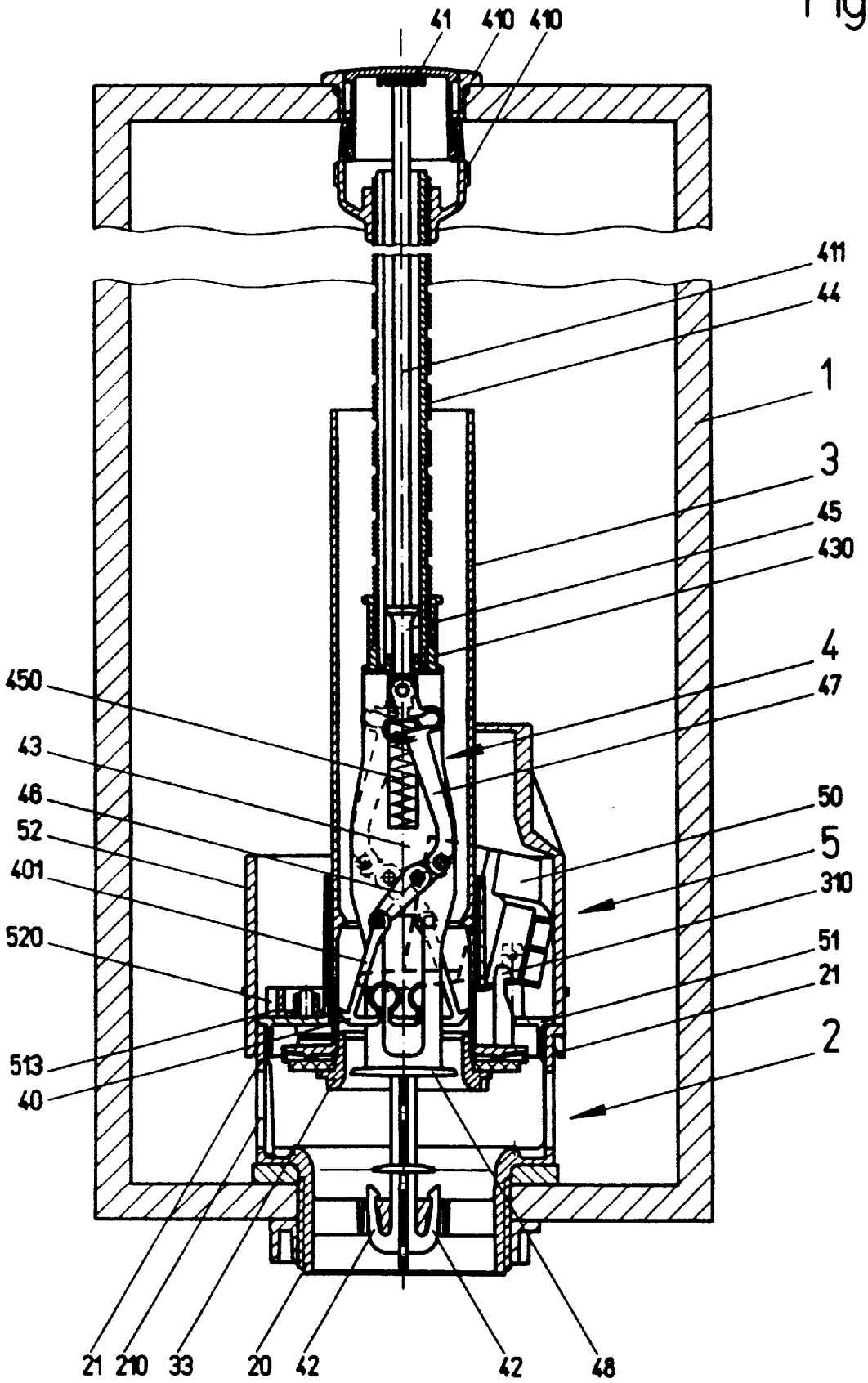
FIG. 4 is a section like FIG. 1 but with the valve in the open but unactuated position.
Figure 9:
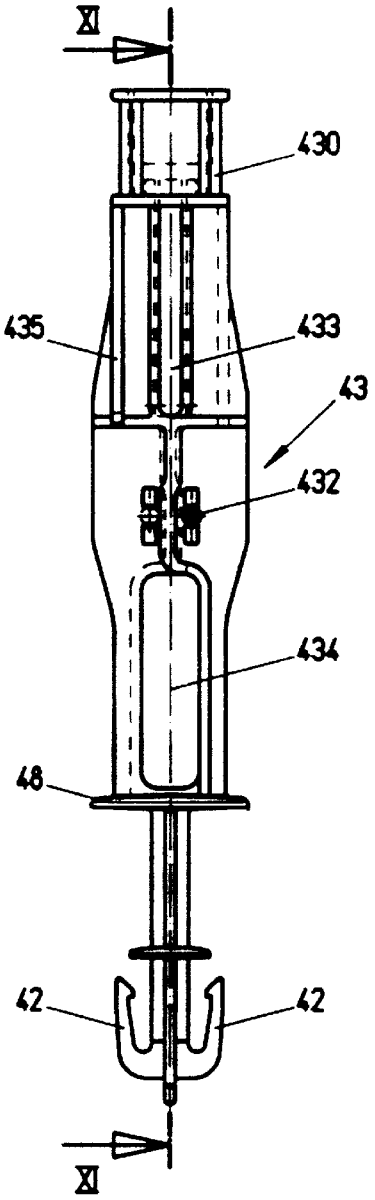
FIGS. 9 and 10 are side views taken at 90° to each other of the support body of the valve mechanism.
Figure 10:
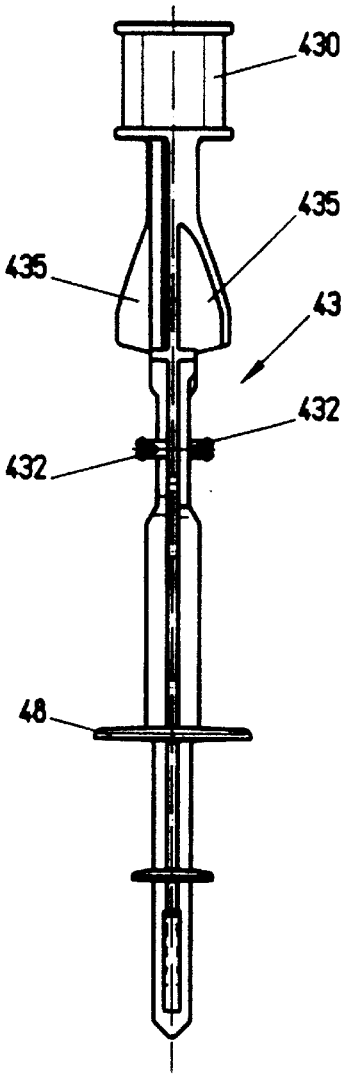
Figure 11:
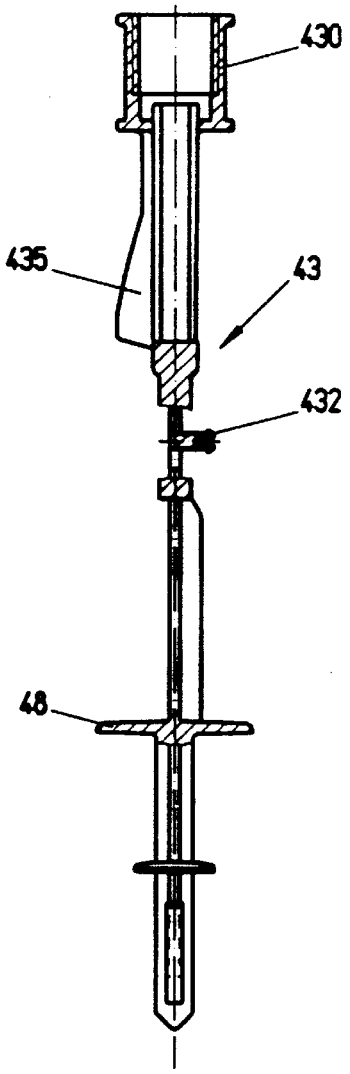
FIG. 11 is a section taken along line XI—XI of FIG. 9.

The valve mechanism 4 as seen in FIGS. 1, 2, and 4 has a button 41 in a sleeve 410 itself mounted in the top wall of the tank and connected via a threaded sleeve 44 to a threaded bore 430 of a mechanism frame or holder 43 shown in detail in FIGS. 9 through 11. A rod 411 extending through the sleeve 44 connects the button 41 with a plunger 45 axially displaceable in the frame 43 and urged upward therein by a spring 450 braced between the frame 44 and a stem 454 (FIG. 12) projecting from a lower end of the plunger 45. This button 41 is pressed downward from the FIG. 1 unactuated position to the FIG. 2 actuated position to flush the toilet equipped with the flush valve of this invention.

More specifically as shown in FIGS. 12 and 13, the plunger 45 has at its upper end a ridge 453 defining a pocket 4520 in which the lower end of the rod 411 engages and is formed with a pair of outwardly projecting tabs 452 that engage in radially throughgoing and axially extending slots 433 (FIG. 8) formed in the frame 43 in which this plunger 45 is axially reciprocal. These tabs 452 are forced through the annular upper end of the frame 43 so that, once they engage in the slots 433, they prevent the plunger 45 from being pushed axially out of the frame 43 by the spring 45. In addition the plunger 45 is formed below each tab 452 with a radially open hole 451 that receives an end pivot pin 427 of a link 47 shown in FIGS. 14 and 15. These links 47 have opposite ends formed with pivot eyes 470 having slots 471 and are centrally formed as springs 473 so that they can compress somewhat longitudinally to absorb any sudden shocks, as for instance if the button 41 is struck sharply.

The pivot eyes 470 engage around pivot pins 460 at upper ends of two-arm levers 46 having opposite ends formed with pivot pins 461. Centrally these levers 46 are formed with holes 462 engaged over pivot pins 432 (FIGS. 8–11) integrally formed on the frame 43. The lower pins 461 fit in eyes 404 formed with slots 403 of a double claw 40 shown in FIGS. 1 and 19 and having arms 401 connecting the eyes 404 to the claws 40. Spring formations 402 urge the claws 40 apart. The links 47, levers 46, and claw 40 are all made of a durable plastic.

Figure 8:
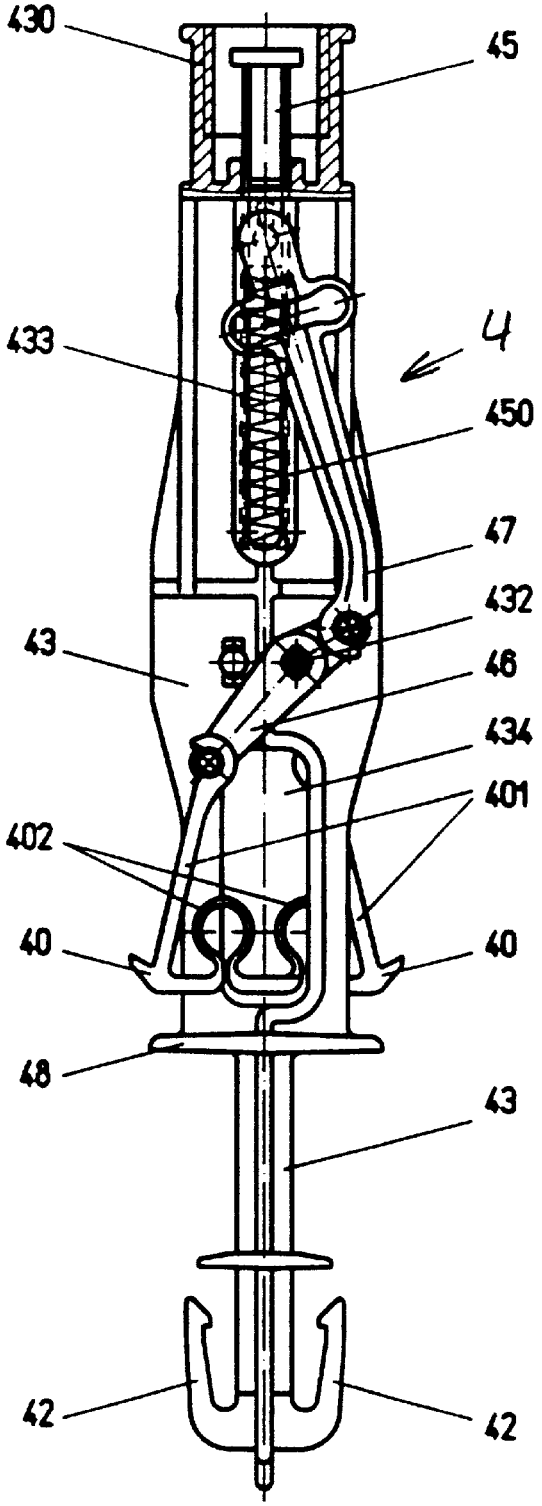
FIG. 8 is a partly sectional side view of the valve actuating mechanism.

As seen in FIG. 8 the spring 402 of the claw 40 projects through a central aperture 434 of the frame 43 which is also formed with ribs 435 (FIGS. 9–11 that center it in the tube 3. In addition this frame 43 is formed above its lower end with a disk 48 that generally blocks flow through the tube 3. At its lower end it has a pair of hooks 42 that can be pushed down through the slot 2011, then rotated through 45° and lifted to latch in the holes 4012 to lock the frame 43 to the valve sleeve 20.

The float and latch system 5 comprises as shown in FIGS. 20 through 24 a lower sleeve-like element 51 that sits snugly in the upper end of the valve sleeve 20 and that has a center collar 510 that slidingly engages around the overflow tube 3 and is formed with grooves 513 that slidingly receive the ribs 34 to prevent this tube 3 from rotating about its axis in the element 51 while permitting it to move axially. In addition the lower element 51 carries a pivot 511 that supports the gudgeons 501 of a U-shaped float 50 having a lip 500 that can engage under the hook 310 (FIG. 5) of the overflow tube 3. As shown in FIG. 1, an upper sleeve 52 has a lower wall formed with a radially throughgoing slot 520 that can be partially or fully blocked by a rotatable wheel 513. This sleeve 52 forms an upward extension of the lower tube 51 that surrounds and protects the float 50 and that can fill with water.

This valve operates a follows:

Normally as shown in FIG. 1 the overflow tube 3, whose lower end acts as a valve body, is sitting atop the seat 24. The sleeve 20 is filled with water as is the sleeve 52 and the float 50 is tipped back as illustrated.

When the button 41 is pushed axially downward as shown in FIG. 3, this movement is transmitted by the rod 511 to the plunger 45 which in turn pushes down the links 47 to pivot the levers 46 about their pivots 432. This action lifts the lower pivots 461 of the levers 46 and raises the double claw 40 that catches under the ridge 30 of the tube 3 to lift this tube 3 off the seat 24. Water will therefore rush through the apertures 210 and out through the port 11. As the tube 3 is lifted the hook 310 will catch on the lip 500 of the float 50 and hang up there so that when the button 41 is released, the tube 3 will be held in the upper open position as shown in FIG. 3 so long as the water level in the upper sleeve 52 is high enough to hold the float in the position of FIGS. 2 and 3.

As the water runs out of the system the upper sleeve 52 will slowly drain through the slot 520 at a rate determined by the setting of the wheel 513. Once the sleeve 52 is substantially empty, the float 50 will pivot back down and pull its lip 500 out from underneath the hook 310, allowing the tube 3 to drop back down into the position of FIG. 1. This action blocks the port 11 and allows the tank to refill.

Meanwhile of course the standard float-controlled valve 6 is pouring water into the tank 1 so that once the tube 3 drops back down, the tank 1 will refill until it reaches the level 10, whereupon the valve 6 will close. If for some reason the tank 1 continues to fill, once the liquid level reaches the top of the tube 3, it can flow down this tube 3 into the toilet, avoiding a flood.

I claim:

1. A flush valve comprising:

a valve ring defining a downwardly open valve port;

an overflow tube centered on an upright axis and having a lower end opening into the valve port;

a valve body at the tube lower end displaceable relative to the port between a closed blocking position and an open position;

means including mechanism inside the tube for lifting the valve body into the open position;

a float in the tank adjacent the port; and latch means connected between the float and the body for holding the body in the open position while the float is generally submerged.

2. The flush valve defined in claim 1 wherein the tube is internally formed with an inwardly projecting ridge, the mechanism including a frame inside the tube and fixed axially in the tank, at least one claw axially displaceable in the tube relative to the frame and engageable with the ridge, an actuating element accessible from outside the tank above the tube and axially aligned with the tube, and a direction-reversing linkage mounted on the frame and connected between the actuating element and the claw for raising the claw when the element is depressed.

3. The flush valve defined in claim 2 wherein the mechanism further includes a tubular guide having a lower end fixed to the frame and an upper end provided with a guide for the actuating element, and a rod extending downward from the actuating element.

4. The flush valve defined in claim 3 wherein the mechanism further includes a plunger axially displaceable in the frame and engaging a lower end of the rod, and a spring braced between the plunger and the frame and urging the rod and element upward.

5. The flush valve defined in claim 4 wherein the mechanism further includes at least one lever centrally pivoted on the frame and having one end connected to the plunger and an opposite end connected to the claw, whereby when the element is moved axially downward the one end moves axially downward and the other end moves axially upward.

6. The flush valve defined in claim 5 wherein the mechanism further includes an axially elastically limitedly compressible link connected between the plunger and the one end of the lever.

7. The flush valve defined in claim 6 wherein the link has a pivot pin and the plunger is formed with seat a radially open seat receiving the pin, the frame being formed with a slot along which the pin is axially displaceable.

8. The flush valve defined in claim 5 wherein the lever has a lower end formed with a pivot pin and the claw is formed with slotted elastically deformable eye engaged over the pivot pin.

9. The flush valve defined in claim 4 wherein the plunger is formed with at least one radially outwardly projecting tab and the frame is formed with an axially extending slot receiving the tab and limiting axial displacement of the plunger in the frame.

10. The flush valve defined in claim 4 wherein the plunger has an enlarged head guided and axially displaceable in the tubular guide.

11. The flush valve defined in claim 2 wherein the claw comprises a pair of diametrally opposite outwardly projecting claws and a spring formation between them and urging them diametrally apart.

12. The flush valve defined in claim 2 wherein the valve body is formed at the axis with a diametral axially throughgoing slot and, angularly offset therefrom with at least one seat, the frame having a lower end formed as a hook engageable through the slot and, on rotation through an angle, in the seat.

13. The flush valve defined in claim 2 wherein the frame is formed below the mechanism with a crosswise partition disk and the overflow tube has a lower end of reduced diameter generally complementary to that of the disk, the disk generally blocking flow through the overflow tube in the open position of the valve body.

14. The flush valve defined in claim 1 wherein the valve body is formed with an upwardly extending large-diameter sleeve spacedly surrounding the tube and formed with radially throughgoing flow apertures, a transverse wall extending inward from an upper end of the sleeve, and an upwardly extending smaller-diameter sleeve closely surrounding and guiding the tube and extending up from the wall.

15. The flush valve defined in claim 14 wherein the float is U-shaped, partially surrounds the smaller-diameter sleeve, and is pivotal above the wall on the valve body between a tipped position when submerged and an untipped position when not submerged, the valve body having an upwardly directed hook engageable through the wall with the float only in the tipped position thereof.

16. The flush valve defined in claim 14 wherein the valve body is further formed with an annular outer wall projecting upward from the wall radially outward of the smaller-diameter sleeve and forming with the wall and smaller-diameter inner sleeve an upwardly open annular compartment holding the float, the valve body being formed with an aperture into the compartment and being provided with means for limiting flow through the aperture, whereby the flow-limiting means can control the rate at which the compartment drains and thereby the amount of time the flush valve will hold open.

17. The flush valve defined in claim 1 wherein the overflow has at its lower end an outwardly projecting flange forming the valve body.

18. The flush valve defined in claim 1 wherein the mechanism is fixed to the valve ring and axially displaceable relative to the overflow tube.

19. The flush valve defined in claim 1 wherein the float is at least partly annular and engages around the overflow tube.

20. The flush valve defined in claim 1 wherein the mechanism includes at least one claw axially displaceable in the tube relative to the frame and engageable with the ridge, an actuating button accessible from outside the tank above the tube and axially aligned with the tube, and a direction-reversing linkage mounted on the frame and connected between the actuating button and the claw for raising the claw when the button is depressed.

* * * * *